US005765278A

United States Patent [19]

Koike et al.

[11] Patent Number: 5,765,278

[45] Date of Patent: Jun. 16, 1998

[54] TERMINAL FEEDING UNIT AND MULTI-CRIMPING APPARATUS EMPLOYING THE SAME

[75] Inventors: Tsuyoshi Koike; Yosinobu Ohta; Teizi Sakuma; Kenichi Taniguchi, all of Yokkaichi, Japan

[73] Assignee: Sumitomo Wiring Systems, Ltd., Mie, Japan

[21] Appl. No.: 554,350

[22] Filed: Nov. 6, 1995

[30] Foreign Application Priority Data

Nov. 7, 1994 [JP] Japan ..... 6-272690
Jun. 28, 1995 [JP] Japan ..... 7-162619

[51] Int. Cl.[6] ..... H01R 43/055

[52] U.S. Cl. ..... 29/753; 29/33 M; 29/564.6; 29/566.2; 29/867

[58] Field of Search ..... 29/33 M, 564.6, 29/566.2, 566.3, 748, 753, 863, 865, 866, 867; 7/107; 72/409.06, 413.14, 446, 712; 100/207; 221/30; 222/80

[56] References Cited

U.S. PATENT DOCUMENTS 4,060,890 12/1977 Dechelette et al. ..... 29/866
4,354,790 10/1982 Karl ..... 100/207 X
4,375,229 3/1983 Mikami et al. ..... 29/753 X
4,398,337 8/1983 Yamaguti et al. ..... 29/564.6
4,587,725 5/1986 Ogawa et al. ..... 29/753
4,862,587 9/1989 Nakata et al. ..... 29/867
5,127,159 7/1992 Kudo et al. ..... 29/863
5,491,887 2/1996 Quinn ..... 29/753
5,575,058 11/1996 Nakamura et al. ..... 29/33 M X

FOREIGN PATENT DOCUMENTS 623909 7/1961 Canada ..... 29/33 M
61-99288 5/1986 Japan ..... 29/753
62-116481 7/1987 Japan ..... 29/753

*Primary Examiner*—Peter Vo
*Attorney, Agent, or Firm*—Beveridge, DeGrandi, Weilacher & Young, LLP

[57] ABSTRACT

A terminal feeding unit reducing preparation time and adapted for multi-item and small-lot production of wire harnesses and a multi-crimping apparatus employing the same are disclosed. Plural terminal feeding units (210) are incorporated into the multi-crimping apparatus (20). Each terminal feeding unit (210) has a carrier cutting section for severing a terminal portion (BS) from a terminal belt (B), a crimping section (214) located at a pressing position (A), and a feeding section (215) for feeding a terminal (T) to the crimping section (214).

11 Claims, 16 Drawing Sheets

TERMINAL FEEDING UNIT AND MULTI-CRIMPING APPARATUS EMPLOYING THE SAME

TECHNICAL FIELD OF THE INVENTION

The present invention relates to a terminal feeding unit and a multi-crimping apparatus employing the same, and more particularly to a terminal feeding unit and a multi-crimping apparatus employing the same which are most suitable for crimping a terminal onto a bared conductor of an insulated electric wire in an automated wire harness fabrication process.

RELATED BACKGROUND ART

An apparatus which normally crimps a terminal onto an end of electric wire is generally used in an automated wire harness fabrication process, the terminal being prepared by severing a terminal portion in the form of a terminal belt having regular spatial intervals therebetween.

As the foregoing apparatus, a terminal feeding unit called an applicator is generally employed. A terminal crimping process has steps of transferring insulated electric wires and terminals to the applicator, and then driving the applicator by a press to caulk the insulated electric wires and terminals transferred thereto, thereby performing a terminal crimping processing for electric wires.

The applicator incorporates a terminal delivery section for delivering terminal portions formed on the terminal belt, a carrier cutting section for severing the so fed terminal portion from the terminal belt, and a crimping section for crimping onto an end of an insulated electric wire a resultant terminal severed off from the terminal belt. The carrier cutting section and the crimping section heretofore are driven simultaneously by the same press.

Plural types of terminals are often crimped, and therefore the applicator need to have a terminal delivery section, a carrier cutting section, and a crimping section corresponding to each type of terminal. An automated wire harness fabricating system including one press for each applicator, as disclosed in Japanese Unexamined Utility Model Publication No. 62-116481 (1987), results in undesirable high costs for the press. On the other hand, in the case where only one press is provided for processing plural types of applicators, the applicators should be mounted or removed manually for exchanging applicators, etc., resulting in cumbersome operation.

To solve this problem, there have been proposed an apparatus capable of automatically exchanging plural types of applicators with respect to one press (see, for example, Japanese Unexamined Patent Publication No. 61-99288 (1986)).

In an arrangement of the apparatus, one applicator is selected from plural applicators sequentially disposed along a predetermined direction in order for the applicator to oppose the press to which the whole body of the selected applicator is then transferred.

Such an applicator or a terminal crimping apparatus employing the applicator is required of adaptability to multi-item and small-lot production of wire harnesses and of high processing accuracy.

In the conventional arrangement described above, however, the applicator needs to be transferred over a long transfer passage, resulting in longer preparation time required for exchanging the applicators. Accordingly, the conventional arrangement may fully cope with volume production but is not suitable for multi-item and small-lot production of wire harnesses, particularly for continuous crimping of different types of terminals.

Furthermore, the applicator is caused to oppose the press once and then the whole body thereof is transferred to the press, so that a long transfer passage is required for transferring the applicator to the press, which entails a disadvantage that an automated wire harness fabricating system becomes bulky.

In the conventional applicator as described above, the same press is used to drive the carrier cutting section and the crimping section for simultaneously performing a process for severing a terminal portion from a carrier and for crimping the severed terminal onto an electric wire, and hence, it is impossible to avoid crimping failure resulting from such simultaneous operation of the severing process and the crimping process.

An object of the present invention is to provide a terminal feeding unit and a multi-crimping apparatus employing the same which are adapted for multi-item and small-lot production of wire harnesses and boast high processing accuracy.

DISCLOSURE OF THE INVENTION

The present invention is directed to a terminal feeding unit and a multi-crimping apparatus employing the same that satisfy this need.

A terminal feeding unit according to a mode of the present invention comprises a terminal delivery section for delivering a plurality of terminal portions in the form of a terminal belt having regular spatial intervals therebetween, a carrier cutting section for severing the fed terminal portion from the terminal belt, a crimping section for crimping a resultant terminal severed off onto an end of an insulated electric wire on a pressure receiving surface, and a feeding section which is movable between a terminal receiving position for clamping the terminal portion to be severed by the carrier cutting section and a terminal delivery position to deliver the resultant terminal severed off onto the pressure receiving surface, and which feeds the terminal severed from the terminal belt, after changing the position of the terminal to facilitate crimping. This arrangement provides a sequential operation of a step for severing a terminal portion from a terminal belt and a step for crimping the severed terminal onto electric wire, thereby avoiding crimping failure which would be resulting from the simultaneous operation of terminal crimping and terminal severing.

According to a preferred mode of the present invention, as interlocked with an operation for receiving a terminal portion at the terminal receiving position, the feeding section clamps the terminal portion, which will be severed from a terminal belt by a slide cutter. This not only simplifies a driving mechanism for the feeding section and the carrier cutting section, but also expedites operations for severing and feeding the terminal portion. Additionally, this mode allows the terminal portion to be severed as securely clamped by the feeding section, thus accomplishing a severing operation of high accuracy with severing failure reduced as much as possible.

According to a more preferred mode of the invention, a leading end of a terminal is conveyed from up to down when the terminal is delivered thereto, whereby interference of the terminal with component members of the pressure surface can be avoided in the course of delivery to the pressure surface. Thus, feeding failure of the terminal can assuredly be prevented.

According to a still more preferred mode of the invention, a terminal is stopped by stop means on the pressure receiving surface upon preventing the deformation, and then is subjected to crimping operation. As a result, it is ensured that bent-up in the crimped terminal is prevented during crimping operation, which eliminates the need for correcting terminal deformation in the subsequent operations.

Another mode of the present invention includes a multi-crimping apparatus, which is incorporated into an automated wire harness fabricating system which automatically fabricates electric wire harnesses by intermittently processing insulated electric wires. The multi-crimping apparatus comprises a plurality of foregoing terminal feeding units, transfer means for carrying the terminal feeding units in such a way as to selectively locate the crimping section at a predetermined pressing position, and a press which is adapted to drive the crimping section located in place thereby crimping a terminal onto the insulated electric wire at the pressing position. In this arrangement, during operation of the automated electric wire harness fabricating system, a specific terminal feeding unit to be selected is firstly moved to locate the crimping section thereof at the pressing position. Thereafter, a terminal portion on a terminal belt advanced from the terminal delivery section is severed from the terminal belt by the carrier cutting section, and the terminal thus severed is transferred to the crimping section. With the terminal at the crimping section, an insulated electric wire is transferred to the pressing position and is superimposed with the terminal. Then the press drives the crimping section to crimp the terminal onto the insulated electric wire. Accordingly, the shortest possible transfer passage can be provided, and hence, downsizing and cost reduction of the automated wire harness fabricating system is accomplished. Furthermore, after the terminal feeding unit is transferred over a short transfer passage, the feeding section simply needs to feed terminals for subjecting different types of terminals to the crimping processing continuously, thereby reducing the preparation time required for exchanging the terminal feeding units. Thus, the mode of the present invention is advantageously adapted for multi-item and small-lot production of wire harnesses.

In the multi-crimping apparatus according to a preferred mode of the invention, the feeding section changes the position of a terminal by 90 degrees, so that a length of the terminal feeding units along the electric wire transfer direction and therefore a length along which the terminal feeding units are sequentially disposed can be reduced. A reduced length along which the terminal feeding units are sequentially disposed allows a stroke of the transfer means to be reduced, which results in an even shorter transfer distance, and hence shorter preparation time.

These and other features, objects, and advantages of the present invention will be more fully apparent from the following detailed description set forth below when taken in conjunction with the accompanying drawings.

DESCRIPTION OF THE PREFERRED EMBODIMENTS

Figure 1:
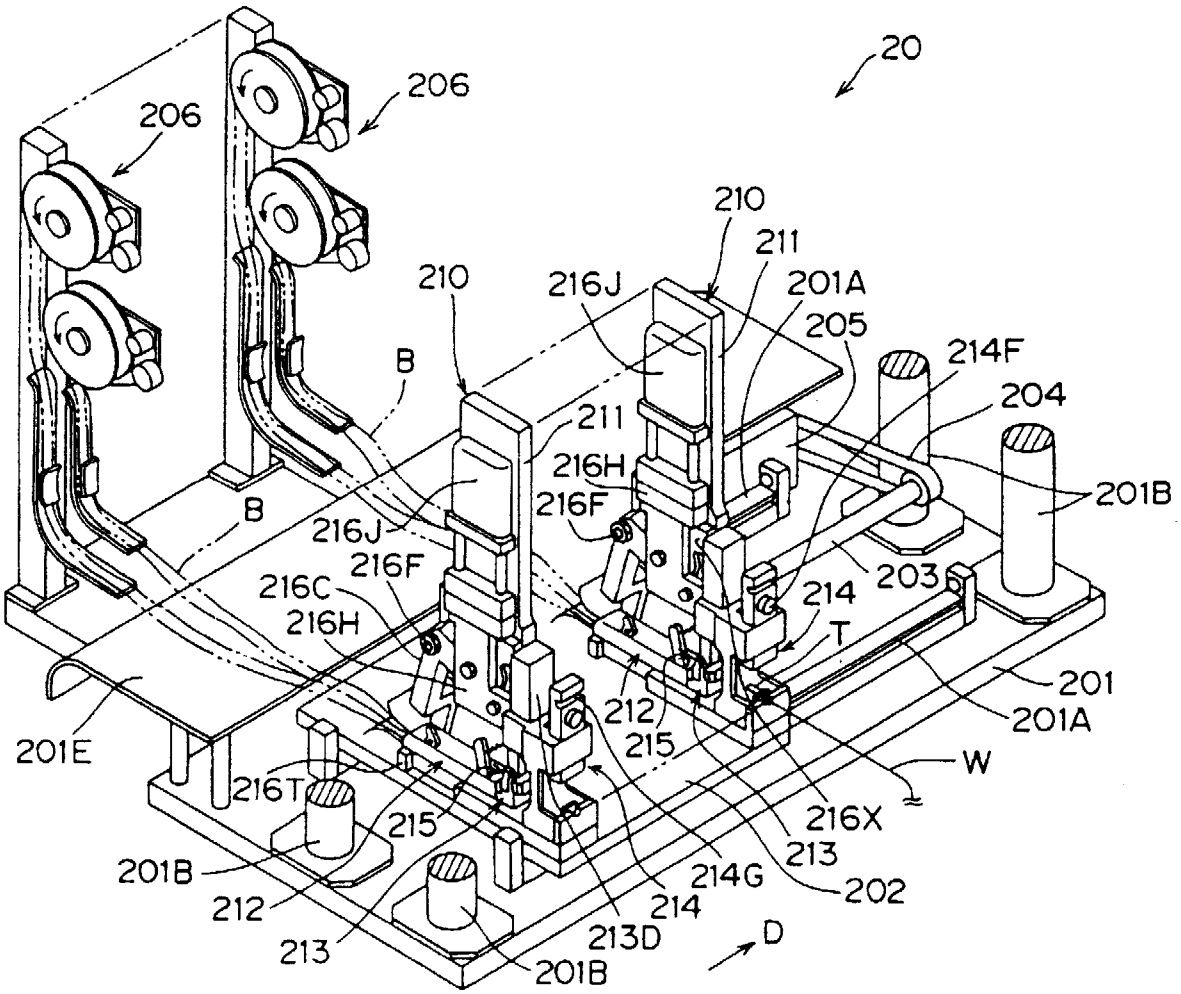
FIG. 1 is a perspective view schematically illustrating the principal part of a multi-crimping apparatus according to an embodiment of the present invention.
Figure 2:
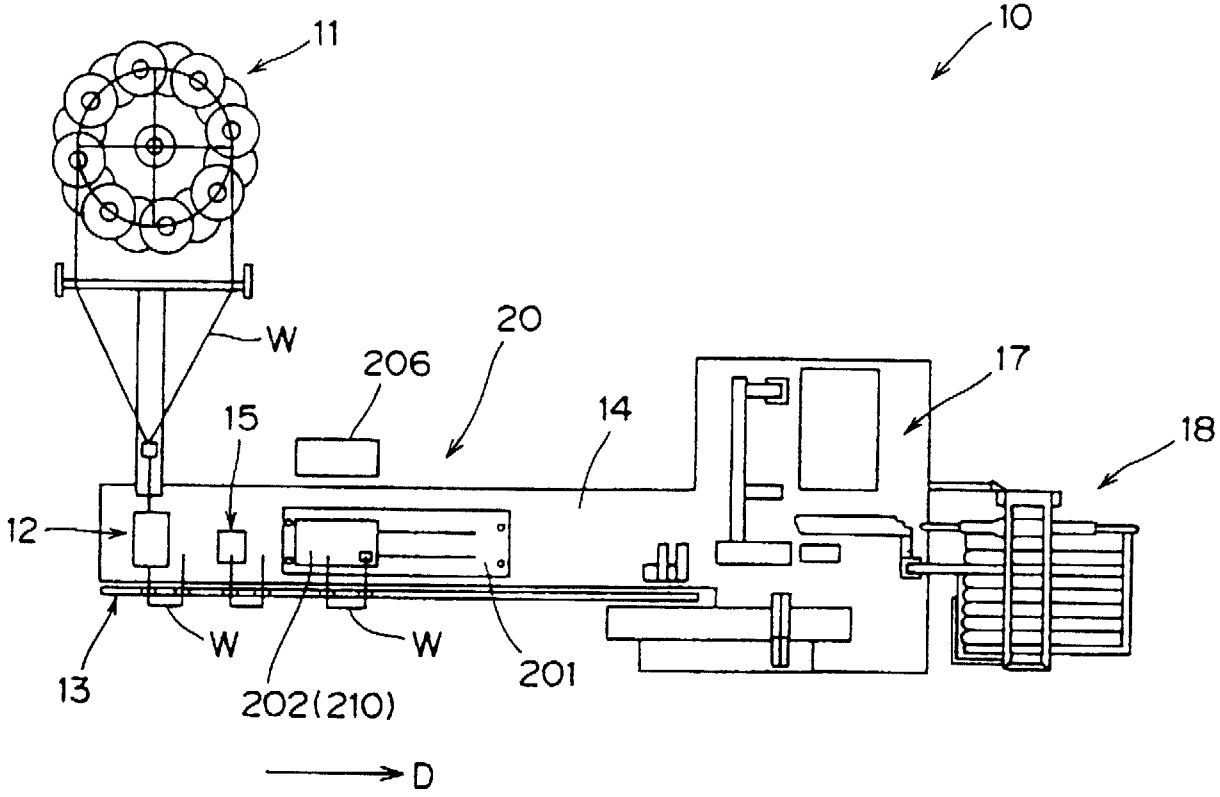
FIG. 2 is a schematic plan view of an automated wire harness fabricating system employing the multi-crimping apparatus of FIG. 1.
Figure 3:
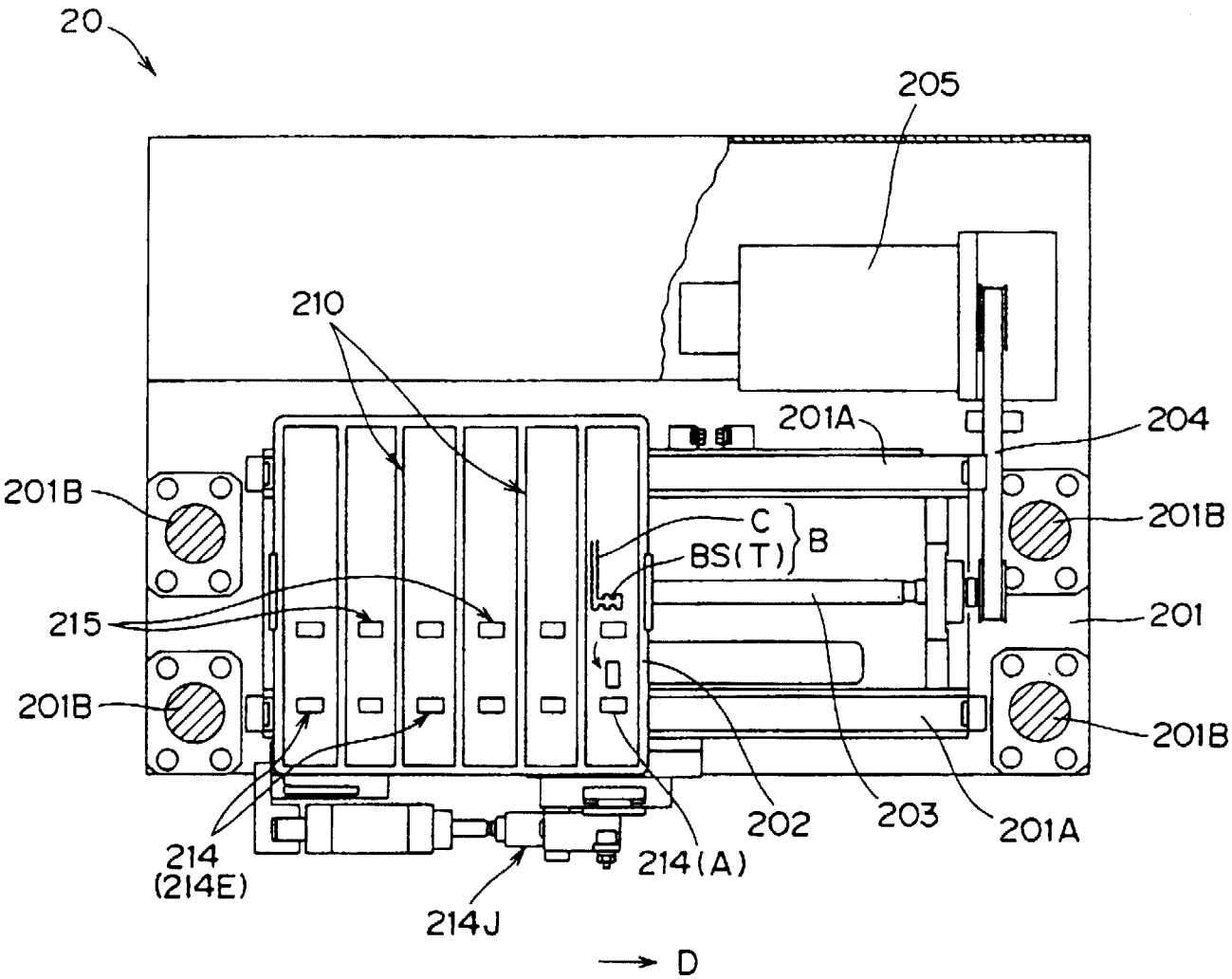
FIG. 3 is a plan view of the multi-crimping apparatus of FIG. 1, partially broken away for the sake of clarity.
Figure 4:
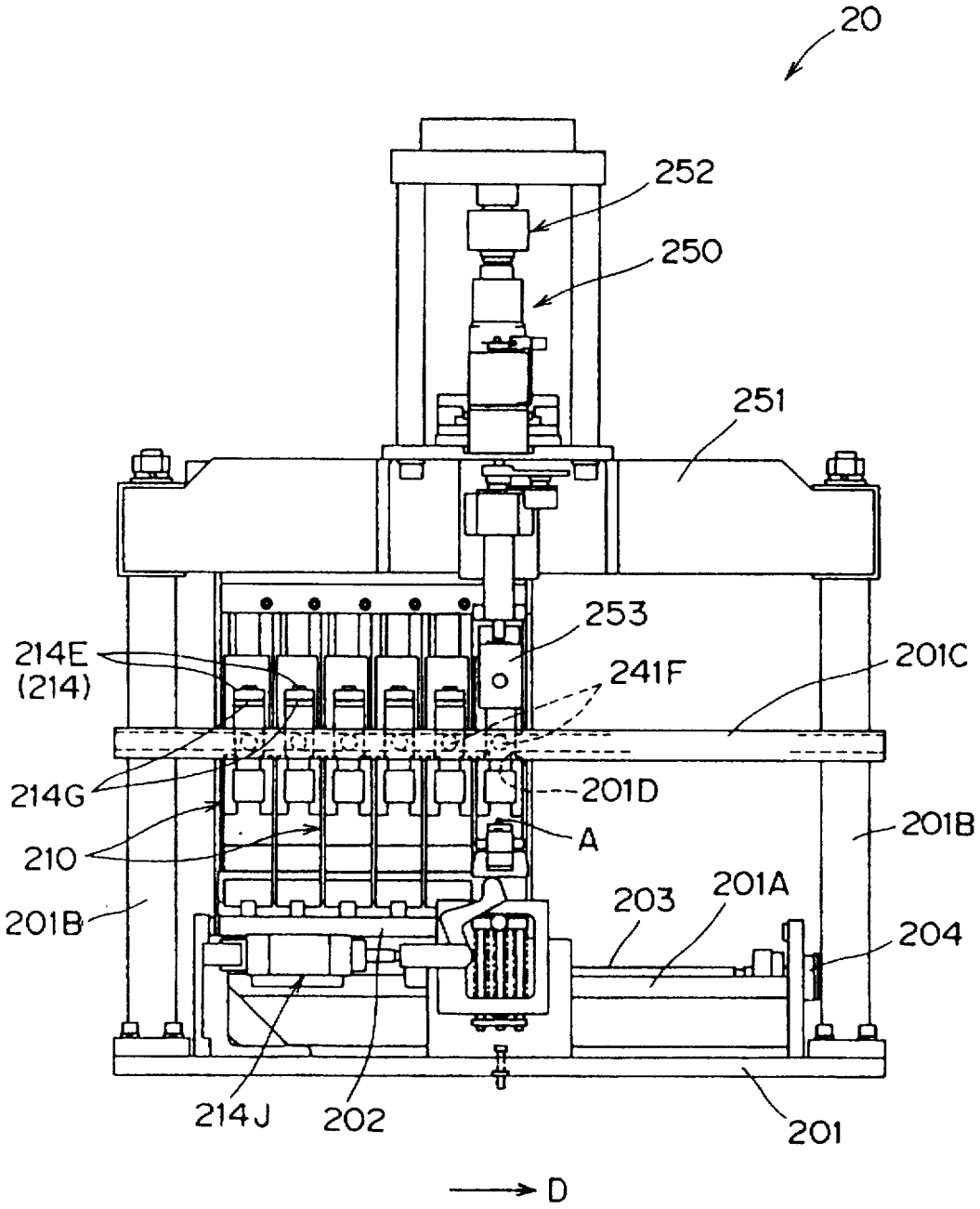
FIG. 4 is a front view of the multi-crimping apparatus of FIG. 1.
Figure 5:
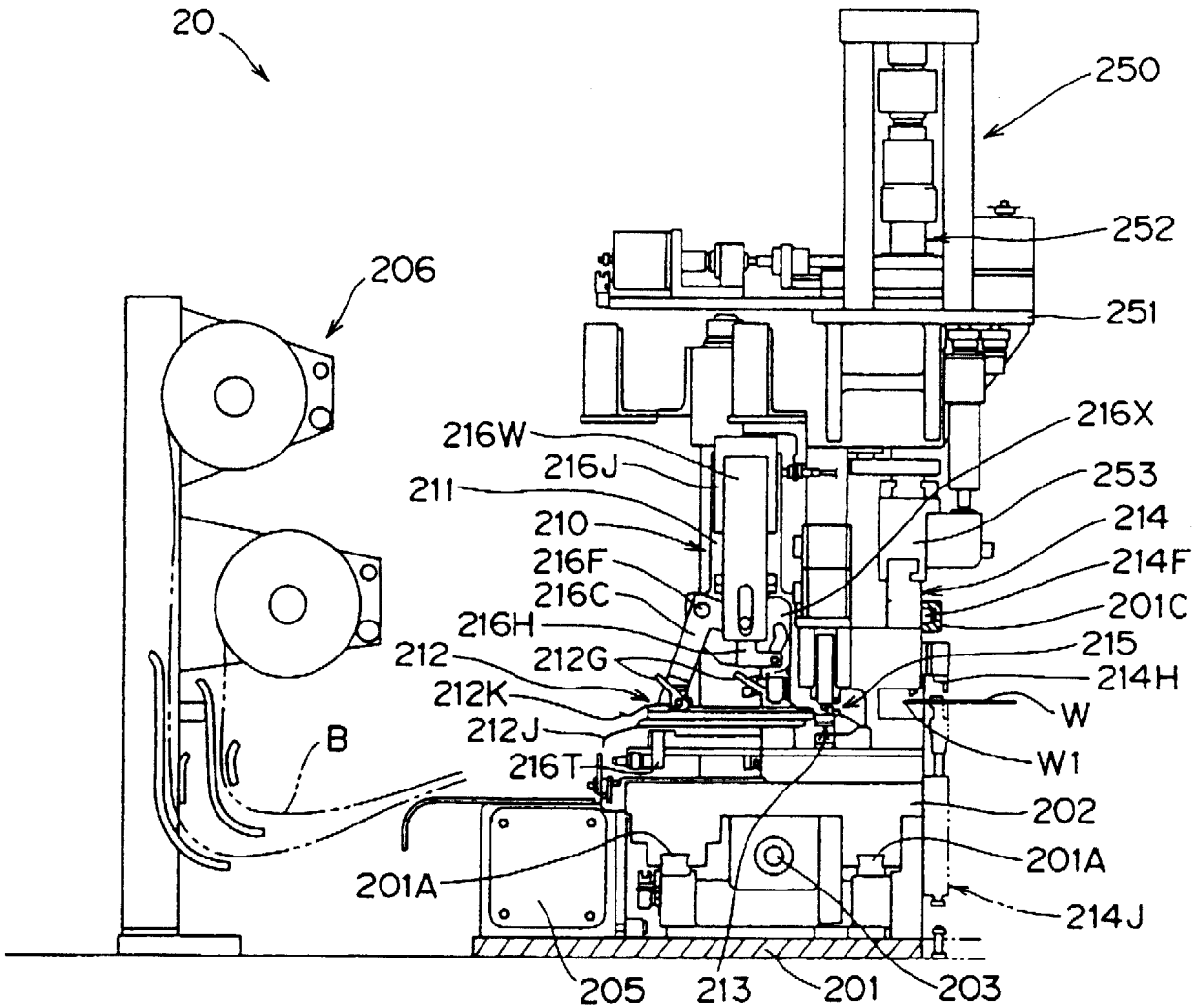
FIG. 5 is a side view of the multi-crimping apparatus of FIG. 1.

FIG. 1 is a perspective view schematically illustrating the principal part of a multi-crimping apparatus according to an embodiment of the present invention. FIG. 2 is a schematic plan view of an automated wire harness fabricating system employing the multi-crimping apparatus shown in FIG. 1. FIG. 3 is a plan view of the multi-crimping apparatus of FIG. 1, partially broken away for the sake of clarity. FIG. 4 is a front view of the multi-crimping apparatus of FIG. 1, and FIG. 5 is a side view of the multi-crimping apparatus shown in FIG. 1.

Referring to FIG. 2, a multi-crimping apparatus according to the present embodiment is incorporated into an automated wire harness fabricating system 10, constituting a part thereof.

The automated wire harness fabricating system 10 comprises an electric wire feeding station 11 which caulks plural types of insulated electric wires W wound up on reels, a measuring and cutting station 12 which draws out a predetermined insulated electric wire W for measuring and cutting, and an electric wire transfer section 13 which intermittently transfers the measured insulated electric wire W. The electric wire transfer section 13 is a known conveyor which carries both ends of a measured insulated electric wire W and conveys the electric wire W from the left to the right side of FIG. 2 with the intermediate portion thereof hung loose in substantially U-shape. On a side of the electric wire transfer section 13, a station 14 is disposed parallel thereto. In the station 14, a stripping station 15 for stripping an insulation from an end of an insulated electric wire W, and a multi-crimping apparatus 20 for crimping a terminal to the stripped end of the insulated electric wire W. Above-mentioned stations are located in the order named from the upstream of the wire transfer section 13. In the embodiment of FIG. 2, there are provided with a terminal insertion station 17 for inserting into a connector housing terminals crimped onto insulated electric wires W, and an electric wire storage 18 for storing insulated electric wires W with which terminals are inserted into the connector housing.

Referring now to FIGS. 1 to 5, the multi-crimping apparatus 20 according to the present embodiment includes a platform 201 mounted on the station 14. The platform 201 is provided with a movable table 202. The movable table 202 is mounted slidably along a transfer direction D of the insulated electric wire W (represented by D in the figures) as to be carried on a pair of slide rails 201A which are provided on the platform 201 along the transfer direction D. Furthermore, the movable table 202 is connected to a ball screw 203 extending along the transfer direction D, and is adapted to travel to the upstream or downstream of the transfer direction D by means of the ball screw 203 which is driven and rotated by a servo motor 205 via a belt mechanism 204.

The movable table 202 is provided with a plurality of terminal feeding units 210 along the transfer direction D (This embodiment includes six units, two of which are shown in FIG. 1). On the other hand, the platform 201 is provided with a press 250 for selectively driving each of the terminal feeding units 210.

The terminal feeding unit 210 of this embodiment will be described in detail hereafter.

Figure 6:
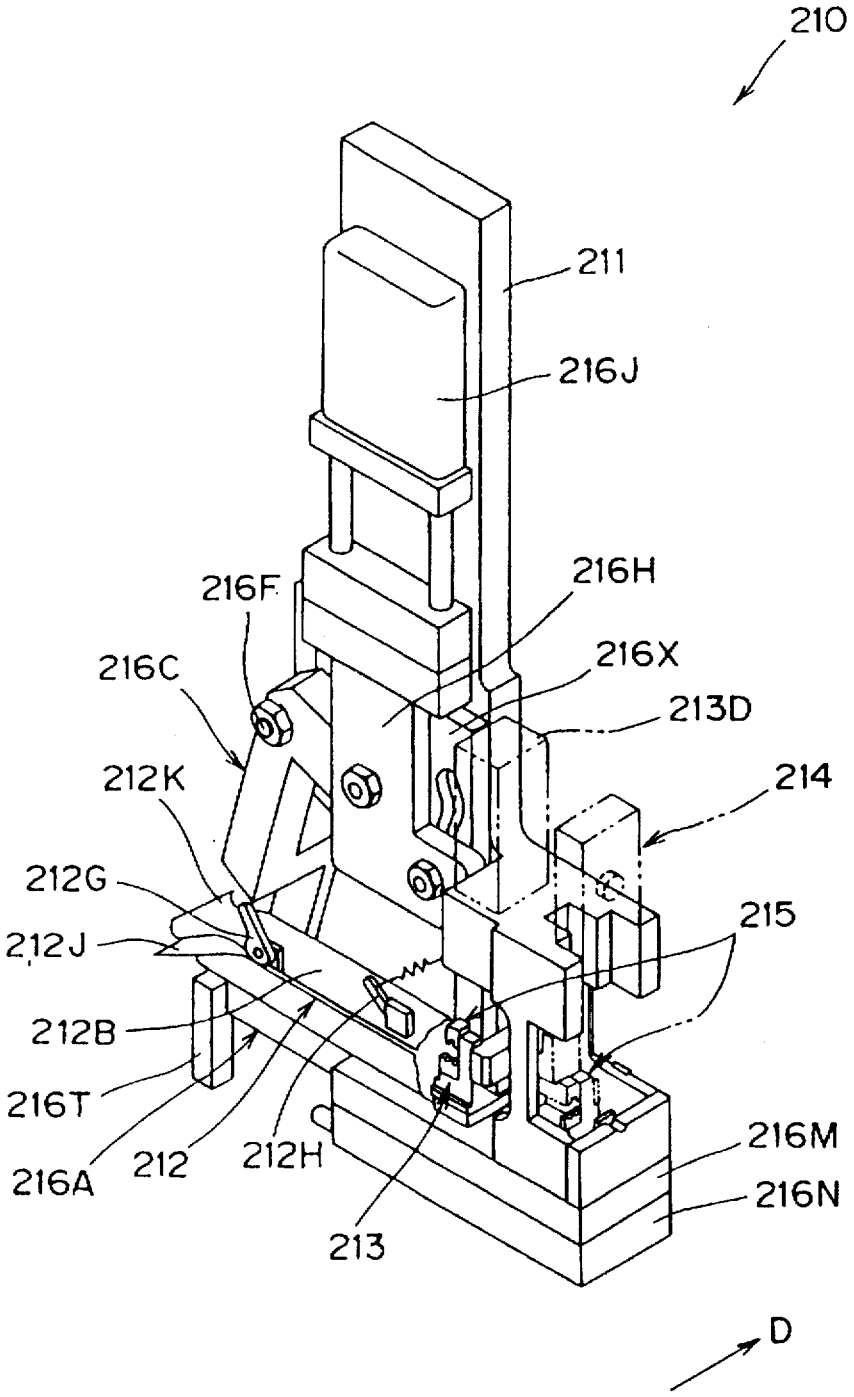
FIG. 6 is a perspective view illustrating schematic construction of a terminal feeding unit according to the embodiment.
Figure 7:
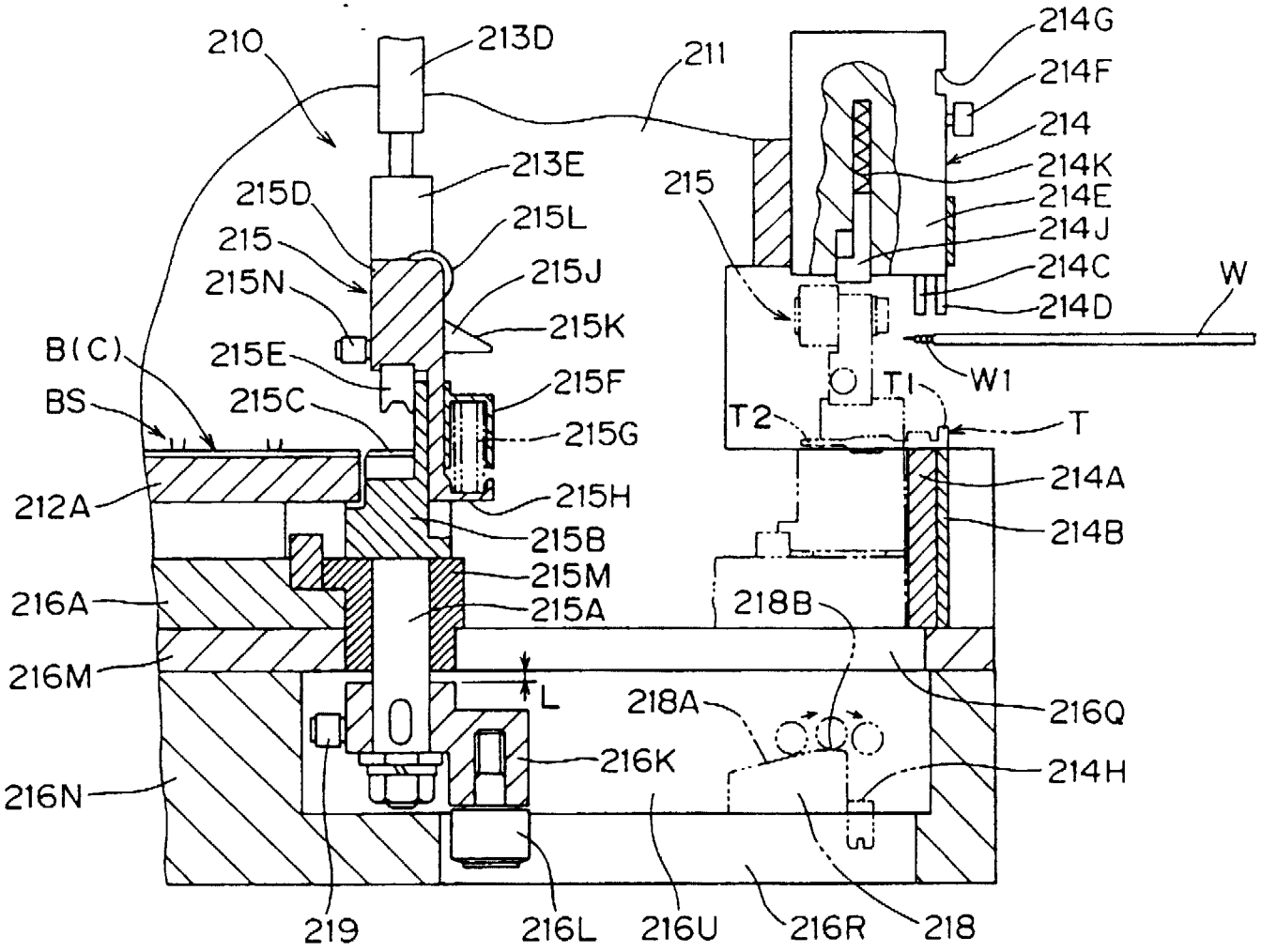
FIGS. 7 and 8 are schematic sectional views illustrating the principal part of the terminal feeding unit.
Figure 8:
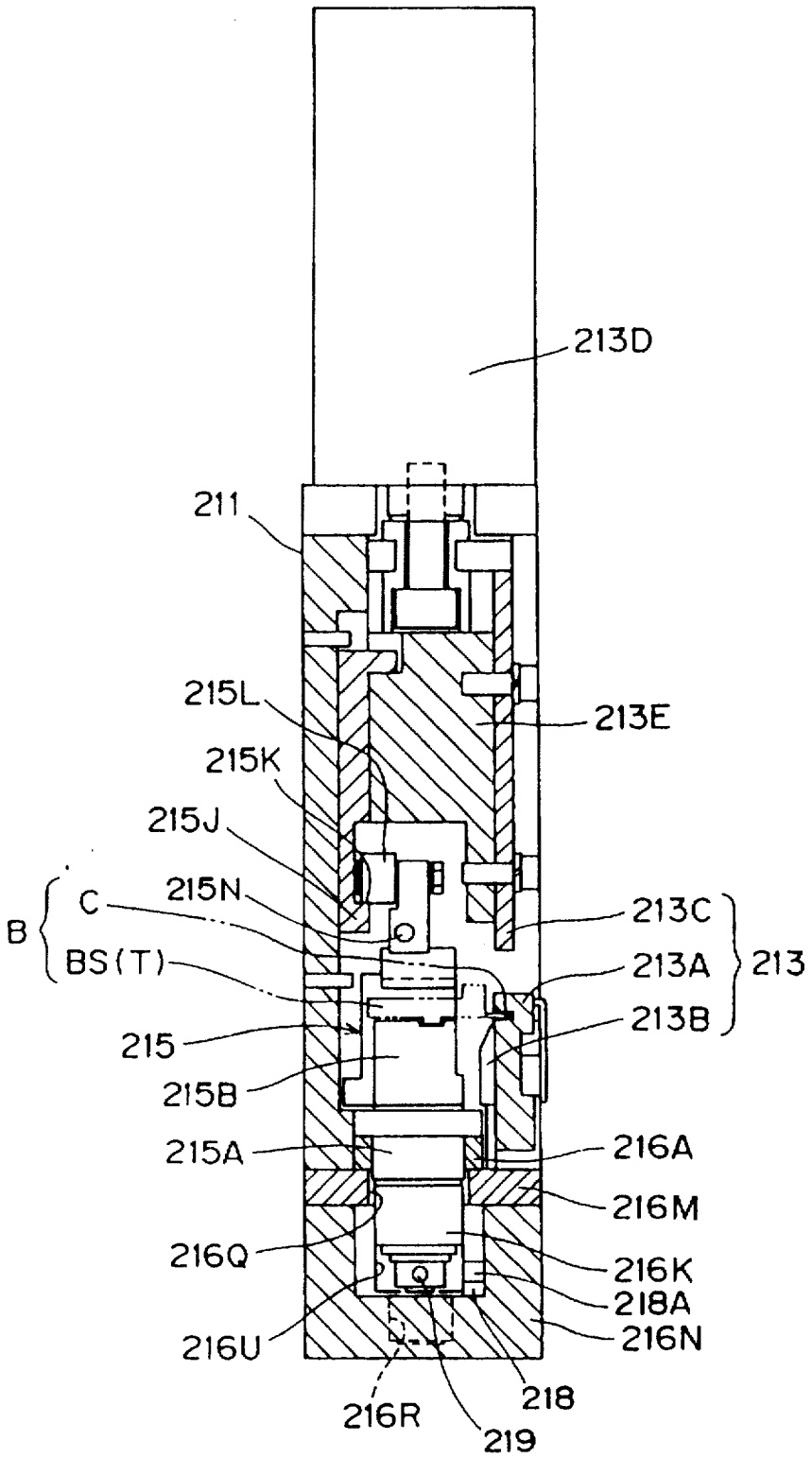
Figure 9:
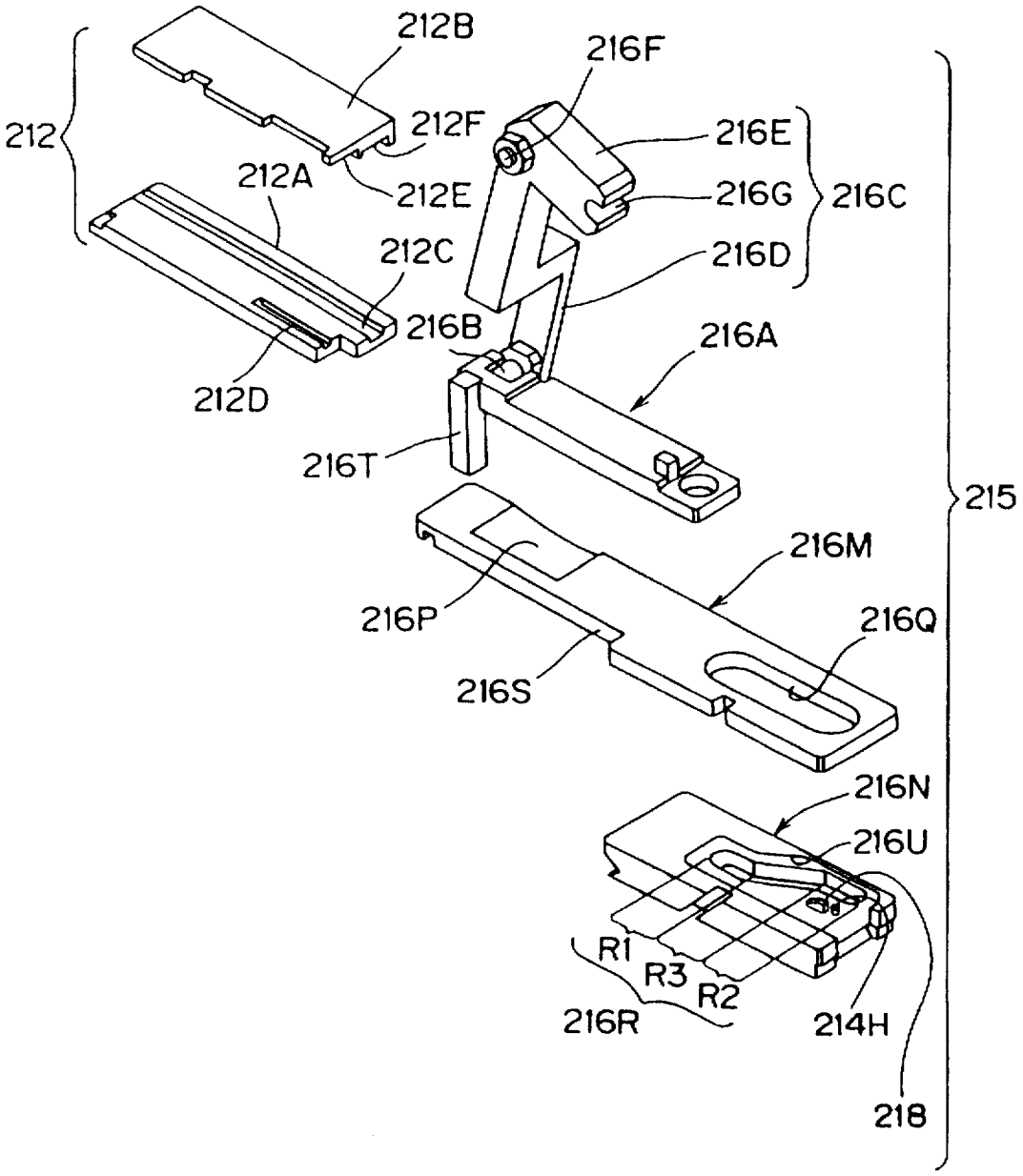
FIG. 9 is an exploded perspective view illustrating the principal part of the terminal feeding unit.
Figure 10:
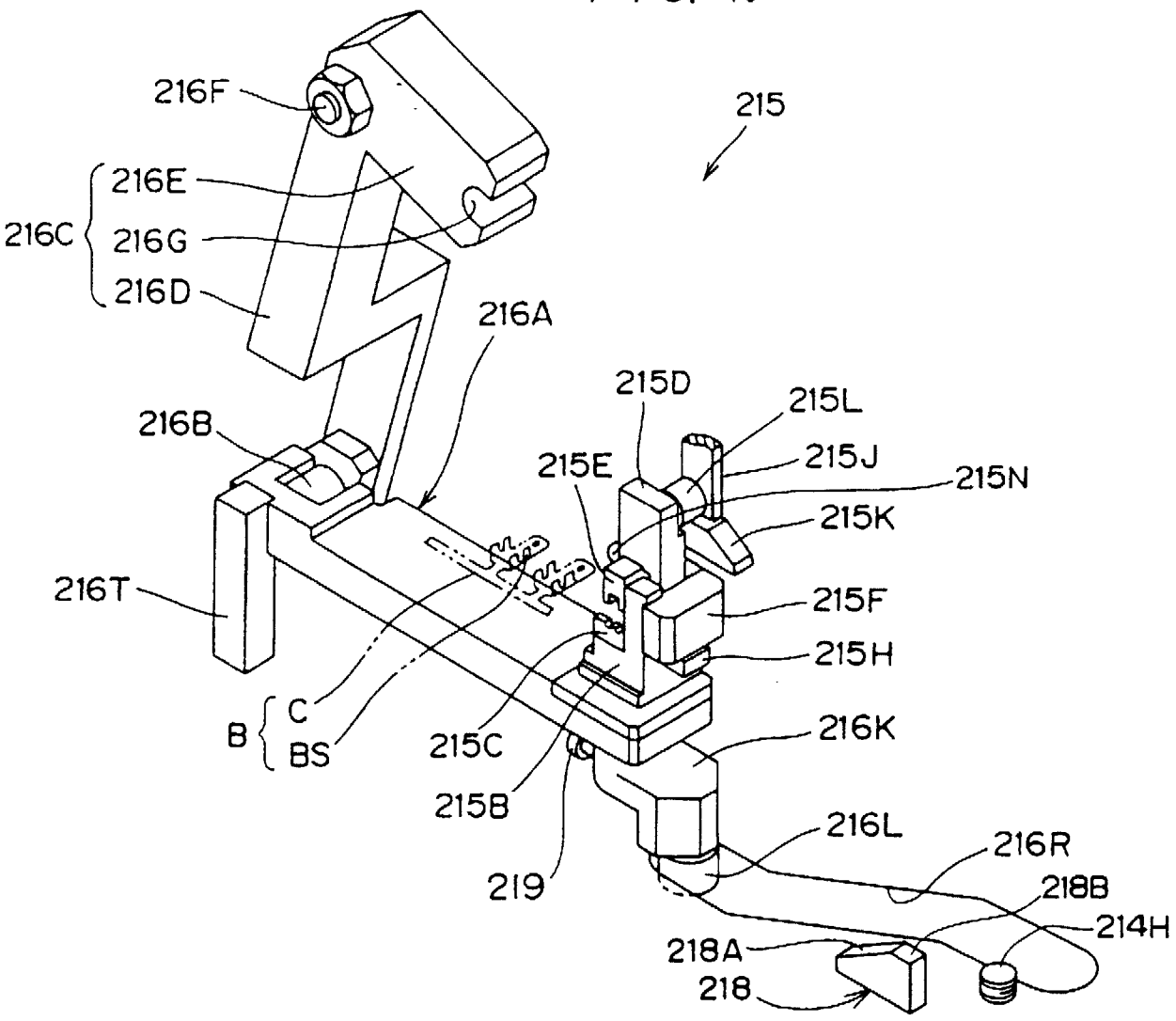
FIGS. 10 and 11 are perspective views illustrating the operation of the principal part of the terminal feeding unit.
Figure 11:
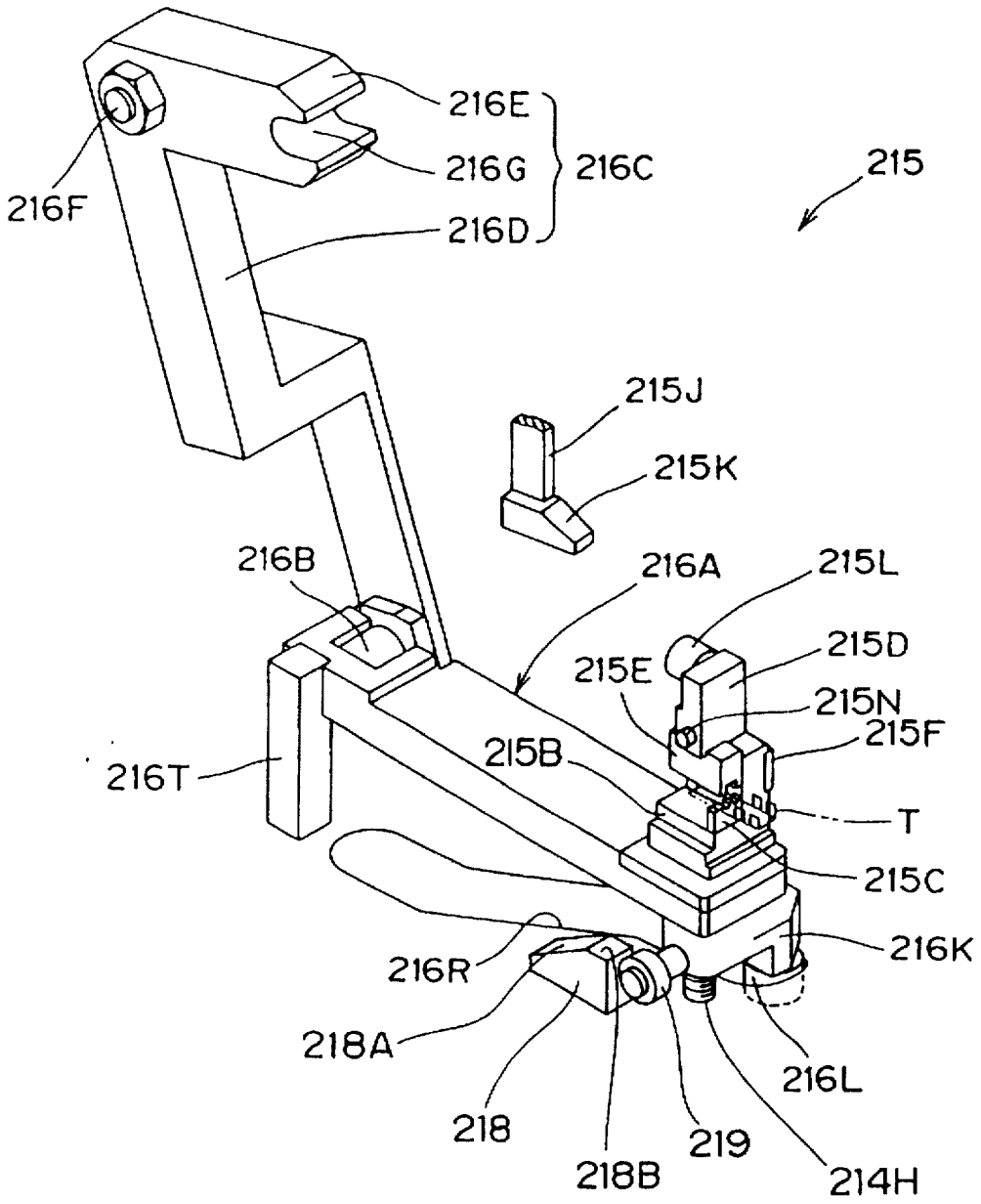

FIG. 6 is a perspective view illustrating the schematic construction of the terminal feeding unit 210 of the present embodiment, FIG. 7 is a schematic sectional view illustrating the principal part of the terminal feeding unit 210, FIG. 8 is a schematic sectional view illustrating the principal part of the terminal feeding unit 210, FIG. 9 is an exploded perspective view illustrating the principal part of the terminal feeding unit 210, and FIGS. 10 and 11 are perspective views illustrating the operation of the principal part of the terminal feeding unit 210.

Referring now to FIGS. 1 to 6, each terminal feeding unit 210 of the present embodiment is mounted on the movable table 202 corresponding to the type of wire harness to be manufactured, and is provided with corresponding terminal belt B from known terminal belt feeding unit 206. The terminal belt B has an elongated carrier BC from which a plurality of terminal portions BS are extending perpendicularly with regular spatial intervals. The terminal belt B is advanced to the terminal feeding unit 210 being guided by a guide plate 201E mounted on the platform 201. The terminal belts feeding unit 206 advances the terminal belt B to the terminal feeding unit 210 in such a way that the terminal portions BS of the terminal belts B are along the electric wire transfer direction D.

Each terminal feeding unit 210 includes a frame 211 which is mounted on the movable table 202. Each frame 211 is of plate shape in complicated relief and has a front face opposing to the electric wire transfer direction D of the electric wire transfer section 13.

Mounted on the frame 211 are a terminal delivery section 212 for delivering the terminal portion BS of the terminal belt B advanced from the terminal belt feeding unit 206, a carrier cutting section 213 for severing the fed terminal portion BS from the terminal belt B, a crimping section 214 for crimping a resultant terminal T severed off to an end of an insulated electric wire, and a feeding section 215 for feeding terminal T to the crimping section 214.

Referring to FIGS. 6 and 9, the terminal delivery section 212 includes a lower guide plate 212A for guiding the lower surface of the terminal belt B, and an upper guide plate 212B opposing the lower guide plate 212A from above, guiding the upper surface of the terminal belt B such that the terminal belt B may be passed between these guide plates 212A and 212 B. Defined in each of the guide plates 212A and 212B are guide grooves 212C, 212D, 212E and 212F which correspond to the shape of terminal portions BS of a terminal belt B to be transferred. The upper guide plate 212B has a pair of feed claw mechanisms 212G and 212H attached thereto, which are intermittently operated to intermittently transfer the terminal belt B. Guide members 212J and 212K for guiding the terminal belt B are disposed at the respective upstream ends of the guide plates 212A and 212B of the terminal feeding section 212 along the terminal transfer direction. The terminal belt B is transferred to the carrier cutting section 213 while maintaining the position thereof as advanced from the terminal belts feeding unit 206, viz., with the terminal portion BS thereof being positioned along the electric wire transfer direction D.

Now referring to FIG. 8, the carrier cutting section 213 comprises a slide cutter 213A for clamping the carrier C of a terminal belt B, a cutting blade 213B for cutting the carrier C in cooperation with the slide cutter 213A, and a punch 213C for vertically driving the slide cutter 213A.

The slide cutter 213A is adapted to move vertically being mounted at a predetermined position on the frame 211 so that the delivery section 215 (to be described later) at the terminal receiving position shown in FIG. 7 can receive a terminal portion BS of a terminal belt B which is transferred from the terminal feeding section 212. Although not shown specifically in the figure, the slide cutter 213A is constantly biased upward by a spring member so as to maintain the position shown in FIG. 8. On the other hand, the cutting blade 213B is integrated with the frame 211 with its blade edge opposing the lower side of the terminal belt B carried by the slide cutter 213A. The punch 213C is disposed above the slide cutter 213A. The punch 213C is mounted to a cylinder 213D which is secured to the upper part of the frame 211 by means of a block-shaped shank 213E. While the terminal belt B is held by the slide cutter 213A, as shown in FIG. 8, the cylinder 213D causes the shank 213E to descend with the punch 213C forcing the slide cutter 213A to move down from a position indicated by the solid line in the figure against the biasing force, whereby the terminal portion BS is severed from the terminal belt B by the shear force acting between the slide cutter 213A and the cutting blade 213B. In this manner, the terminal T is formed.

Referring now to FIG. 7, the crimping section 214 comprises a conductor anvil 214A and an insulated electric wire anvil 214B which are fixed at the side of the electric wire transfer section 13 of the frame 211 and a conductor crimper 214C and an insulated electric wire crimper 214D which are vertically movably supported overhead and opposed to the anvils 214A and 214B respectively.

The conductor anvil 214A and the conductor crimper 214C crimp an electric wire barrel portion of a terminal T onto a bared conductor end W1 of an insulated electric wire W transferred by the electric wire transfer section 13. The insulated electric wire anvil 214B and the insulated electric wire crimper 214D crimp an insulation barrel portion of the terminal T onto an insulated portion of the insulated electric wire W.

To provide vertical movability to the crimpers 214C and 214D, the crimpers 214C and 214D are movably attached to the frame 211 by means of a shank 214E. The shank 214E is movably mounted at the side of the electric wire transfer section 13 of the frame 211.

Referring to FIG. 3, the shank 214E is sequentially disposed along the electric wire transfer direction D and mounted at such position to oppose a pressing position A to be pushed by the press 250 (described later). That is, the shank 214E of each terminal feeding unit 210 is disposed at such a position as to be transferred to the pressing position A by shifting the movable table 202.

More detailed description is given with reference to FIGS. 3 to 6. The movable table 202 has a part thereof located under a conductor end W1 of an insulated electric wire W transferred by the electric wire transfer section 13 so that the crimping section 214 of the terminal feeding unit 210 can oppose beneath the conductor end W1. The pressing position A is prescribed at a predetermined position where the electric wire transfer section 13 halts the bared conductor end W1, so that any one of the shanks 214E of the terminal feeding units 210 may be selectively transferred to the pressing position A by shifting the movable table 202.

Now referring to FIG. 4, pillars 201B are located at the four corners of the platform 201, and a guide beam 201C for guiding the shank 214E bridges two of the pillars 201B located at the side of the electric wire transfer section 13. The guide beam 201C is shaped like a channel having an open-ended-square section which is inverse of the electric wire transfer section 13. The shank 214E of each terminal feeding unit 210 has a front surface on which is attached a roller 214F rotatably within the recess of the guide beam 201C. This allows the shank 214E to smoothly follow the movement of the movable table 202 as guided by the guide beam 201C when the movable table 202 moves along the electric wire transfer direction D.

The guide beam 210C is formed with a drop groove 201D at a place corresponding to the pressing position A. The drop groove 201D is designed to allow the roller 214F to move therethrough downwardly, thereby allowing the shank 214E at the pressing position A to move downward during the operation by the press 250 (to be described later), so that a crimping terminal T may be crimped onto the conductor end W1 of an insulated electric wire W. In other words, the other shanks 214E positioned out of the pressing position A are connected to the guide beam 201C by means of the rollers 214F respectively, and thus the downward movement of the shanks 214 is restricted.

The shank 214E has a transverse groove 214G for linking up with the press 250 (to be described later). Groove 214G is defined in the front surface of the shank 214E above the roller 214F.

The feeding section 215 of the present embodiment will be described in detail hereafter. The feeding section feeds a terminal T between the anvils 214A and 214C and the crimpers 214B and 214D of the crimping section 214, the terminal T having been severed from a terminal belt B by the carrier cutting section 213.

More detailed description will be given with reference to FIGS. 6 to 8. The feeding section 215 of the present embodiment can move between a terminal receiving position shown by the solid line in FIG. 6 and a terminal delivery position shown by the Phantom line in FIG. 6, and includes a shaft 215A extending vertically, as shown in FIG. 7. The shaft 215A is integrally at its upper part with a block 215B to which is secured a terminal receiving plate 215C for receiving a terminal portion BS of a terminal belt B delivered from the terminal delivery section 212. To clamp the delivered terminal portion BS in cooperation with the terminal receiving plate 215C, affixed to the block 215B is a chucking arm 215D which is vertically movable relative to the block 215B. Attached to the chucking arm 215D is a terminal press 215E which vertically opposes the terminal receiving plate 215C.

Also referring to FIG. 10, the block 215B is provided integrally with a spring holder 215F which contains therein a helical compression spring 215G. The helical compression spring 215G is compressed between a spring seat 215H extended from the chucking arm 215D and the spring holder 215F in order to constantly bias the chucking arm 215D downwardly so that the resultant biasing force causes the terminal portion BS to be clamped between the terminal receiving plate 215C and the terminal hold 215E.

In order for the feeding section 215 at the terminal receiving position to receive a terminal portion BS of the terminal belt B delivered from the terminal delivery section 212, the chucking arm 215D is moved upwardly by means of a cam mechanism so as to provide a space between the terminal receiving plate 215C and the terminal hold 215E.

More detailed description will be given with reference to FIGS. 7 and 8. The shank 213E for driving the punch 213C of the carrier cutting section 213 includes the cam member 215J at the opposite side of the punch 213C. The cam member 215J has a slant cam surface 215K which is inclined more downwardly the more downstream the terminal belt B is transferred along the transfer direction of the terminal belt B. Attached to the chucking arm 215D is a cam roller 215L which comes into rolling contact with the slant cam surface 215K. When the feeding section 215 is at the terminal receiving position, the cam roller 215L gets onto the slant cam surface 215K, as shown by the solid line in FIG. 7, thereby providing a space between the terminal receiving plate 215C and the terminal hold 215E for receiving the terminal portion BS. The biasing force of the helical compression spring 215G causes the terminal receiving plate 215C and the terminal press 215E to clamp the terminal portion BS therebetween when the cam roller 215L leaves the slant cam surface 215K.

Additionally, as described above, the terminal severing operation by the carrier cutting section 213 is performed by the shank 213E integrally carrying the cam member 215J. In this embodiment, the operation for the carrier cutting section 213 to sever a terminal portion BS from a terminal belt T is interlocked with an operation for the feeding section 215 to clamp the resultant terminal T thus severed, so that the slide cutter 213A is driven immediately after the terminal portion BS is clamped by the terminal receiving plate 215C and the terminal hold 215E.

Now, description is given on a mechanism for shifting the feeding section 215 to feed a clamped terminal T to the crimping section 214.

Referring to FIGS. 6 to 11, the shaft 215A of the feeding section 215 is attached to an end of a slider 216A substantially shaped like a plate, by means of a sleeve 215M. The sleeve 215M is attached to one end of the slider 216A rotatably about the axis of the shaft 215A, and caulks the shaft 215A slidably about and along the axis of the shaft 215A. This permits the bottom of the block 215B having a greater diameter than the shaft 215A to be seated upon the top of the sleeve 215M by the weight of the feeding section 215.

The slider 216A is disposed beneath the lower guide plate 212A of the terminal delivery section 212, and can move along the direction in which the terminal delivery section 212 transfers a terminal. A pivot arm 216C is integrally provided with the other end of the slider 216A by means of a link roller 216B.

The pivot arm 216C is integrally provided with a first arm 216D supporting the link roller 216B at the free end thereof and a second arm 216E substantially bent like a letter-L relative to the first arm 216D, as viewed from the front (a surface intersecting the electric wire transfer direction D), with the joint portion of the arms 216D and 216E being supported on the front surface of the frame 211 by means of a bolt 216F. The first arm 216D is bent substantially like a crank, as viewed from the side, and is pivotable above the terminal delivery section 212.

In order to move the slider 216A by turning the pivot arm 216C, the pivot arm 216C includes a recess 216G formed in a free end of the second arm 216E, and is coupled to a link member 216H via a cam roller (not shown) to be fitted in the recess 216G.

The link member 216H is vertically movably supported by the frame 211 by means of a guide member 216W (shown only in FIG. 5). Additionally, the link member 216H is coupled to a cylinder 216J secured to the frame 211 and is adapted to be driven upwardly or downwardly by the cylinder 216J. Provided at the side of the guide member 216W is a cam member 216X (see FIG. 6), which is linked with the link member 216H by a cam not shown, thereby prescribing a pivot stroke of the pivot arm 216C.

A crank-shaped rotary arm 216K is integrally secured to the lower end of the shaft 215A of the feeding section 215. According to the present embodiment, the rotary arm 216k is so mounted as to define a clearance L (1 mm in the present embodiment) between the top surface thereof and the bottom surface of the sleeve 215M, when the bottom of the block 215B is seated on the top of the sleeve 215M by the weight of the feeding section 215. Accordingly, conjointly with the shaft 215A passing through the slider 216A as being axially movable relative thereto, the feeding section 215 may be lifted upwardly, by this clearance L, from the slider 216A.

The rotary arm 216K is provided at the bottom thereof with a roller 216L having a center of rotation parallel to the shaft 215A. For driving the rotary arm 216K and the roller 216L, a first cam plate 216M is provided beneath the slider 216A, and a second cam plate 216N is provided beneath the first cam plate 216M, as shown in FIG. 9 in detail.

Referring to FIG. 9, the first cam plate 216M caulks the lower surface of the slider 216A, and is formed with a recession 216P at a predetermined position thereof for avoiding interference with the link roller 216B to be linked with the slider 216A. The cam plate 216M is formed with an elongated hole 216Q at one end thereof which receives the roller 216L, and the sleeve 215M is in rolling contact with the elongated hole 216Q. The first cam plate 216M is formed with a shoulder 216S which prescribes an amount of stroke of a stopper 216T attached to an end of the slider 216A.

The second cam plate 216N is directly fixed to the movable table 202, and includes a cam hole 216R which receives the roller 216L. The cam hole 216R forms end portions R1 and R2 parallel to each other, and an inclined portion R3 interconnecting the both end portions R1 and R2. The cam roller 216R receives the roller 216L therein causing rolling contact therewith, thereby allowing the shaft 215 to change the position by 90 degrees as seen in the plan view. A peripheral groove 216U is defined along the upper periphery of the cam hole 216R so as to prevent interference with the rotary arm 216K.

Now, more detailed description will be given referring to FIGS. 3, 6, 10 and 11. When a rod of the cylinder 216J is lowered to press down the free end of the second arm 216E of the pivot arm 216C by means of the link member 216H, the slider 216A is shifted to the opposite side of the electric wire transfer section 13. Accordingly, the rotary arm 216K and the roller 216L in the elongated hole 216Q and the cam hole 216R are shifted respectively to the opposite side of the electric wire transfer section 13, and the feeding section 215 waits to receive a terminal portion BS of a terminal belt B at the terminal receiving position.

In the above-described situation, when the rod of the cylinder 216J rises and therefore the free end of the second arm 216E of the pivot arm 216C pivots about the bolt 216F counterclockwise in the figure, the slider 216A approaches the electric wire transfer section 13 causing the rotary arm 216K and the roller 216L to shift as rolling in the elongated hole 216Q and the cam hole 216R respectively, whereby the feeding section 215 is allowed to feed a terminal T severed off to the crimping section 214 at the terminal delivery position.

In the present embodiment, some considerations are given to a process in which a terminal portion BS is severed from a terminal belt B and a resultant terminal T is fed to the crimping section 214, as described above.

Firstly, in order to prevent the leading end T2 of a terminal T from interfering with the anvil 214A at the upstream of the terminal delivery direction when a terminal T severed off is placed upon the respective pressure receiving surfaces of the anvils 214A and 214B of the crimping section 214, this embodiment is arranged such that the terminal T is lifted upward during the delivery process so as to be conveyed to the anvils 214A and 214B of the crimping section 14 from up to down on the pressure receiving surfaces. To materialize such an arrangement in the present embodiment, there are provided with the clearance L, as described above, which permits uplift of the terminal T clamped by the feeding section 215; a cam projection 218 upstanding from a predetermined position of the second cam plate 216N as shown in FIGS. 7, 10 and 11; and a cam roller 219 attached to the rotary arm 216K of the feeding section 215, for rolling contact with the upper surface of the cam projection 218. The cam projection 218 defines a lifting slant 218A inclined upward from the carrier cutting section 213 to the crimping section 214, and a stop surface 218B which is continuous with the lifting slant 218A and maintains a given height. The cam projection 218 and the cam roller 219 are so designed as to attain the following steps during the process when the feeding section 215 transfers the terminal T from the carrier cutting section 2143 to the crimping section 214: lifting, by the clearance L shown in FIG. 7, the terminal T which is clamped between the terminal receiving plate 215C and the terminal press 215E by lifting the shaft 215A via the rotary arm 216K by the cam roller 219 which is getting onto the lifting slant 218A; facing the lifted terminal T to the pressure receiving surfaces of the respective anvils 214A and 214B by rolling contacting the cam roller 219 with the stop surface 218B; and placing the terminal T onto the pressure receiving surfaces of the anvils 218A and 218B by leaving the cam roller 219 from the cam projection 218.

In the present embodiment, there is required a prevention against deformation including "bent-up" or "bent-down" which may occur between a barrel portion T1 and a distal end T2 of a terminal T due to the behavior of the feeding section 215 during a crimping operation, because the crimping section 214 crimps the terminal T onto an insulated electric wire W with the terminal T clamped between the terminal receiving plate 215C and the terminal hold 215E of the feeding section 215. In the present embodiment therefore, as shown in FIGS. 7, 9, 10 and 11, there are provided with a set screw 214H disposed at a predetermined place of the cam plate 216N, for enabling the positioning of the bottom of the shaft 215A of the feeding section 215 at the terminal delivery position; and a press portion 214J disposed on the shank 214E of the crimping section 214, for preventing the terminal T from being bent by pressing the feeding section 215 in order to clamp the feeding section 215 jointly with the set screw 214H prior to crimping action of the terminal T. The press portion 214J and the shank 214E are interconnected by a helical compression spring 214K by which the shank 214E is restricted from applying the total pressing load thereof to the feeding section 215, after the press portion 214J pressed the feeding section 215 against the set screw 214H with a predetermined load. A chucking arm 215D of the feeding section 215 has a pressure receiving projection 215N attached thereto for receiving a load of the press portion 214J.

The press 250 employed in the multi-crimping apparatus of the present embodiment will be described in detail hereafter.

Referring to FIGS. 4 and 5, the press 250 according to the embodiment of the present invention comprises a pedestal 251 which rests on the top of the pillars 201B and a piston mechanism 252 supported by the pedestal 251. The piston mechanism 252 opposes the pressing position A, as seen in the plan view. Secured at the lower part of the piston mechanism 252 is a punch 253 to be coupled to the transverse groove 214G in the shank 214E which has been transferred to the pressing position A. The punch 253 is caused to descend from a position shown in FIGS. 4 and 5, to drive the shank 214E downward thereby crimping a terminal T.

In the present embodiment, an electric wire press bar 214H (shown in FIG. 5 only) is integrally fixed to the shank 214E, and the platform 201 is provided with a pressure receiving mechanism 214J (see FIGS. 3 and 4) for elastically receiving the electric wire press bar 214H, so that an insulated electric wire W is pressed downward to be elastically clamped between the electric wire press bar 214H and the pressure mechanism 214J when the punch 253 descends, thereby preventing deformation of the insulated electric wire W due to excessive bending.

Although not specifically shown in the figures, the aforementioned automated electric wire harness fabricating system 10 comprises a control unit, which drives the multi-crimping apparatus 20 interlocking it with other working processes in the following manner.

That is, during operation of the automated electric wire harness fabricating system 10 (see FIG. 2), the servo motor 205 firstly drives the movable table 202 to transfer a particular terminal feeding unit 210 to be selected, thereby leading the crimping section 214 of the terminal feeding unit 210 to oppose the pressing position A and coupling the shank 214E of the crimping section 214 to the punch 253 of the press 250. Thereafter, when a terminal portion BS of a terminal belt B which is delivered by the terminal delivery section 212 of the terminal feeding unit 210 and is further delivered to the feeding section 215 at the terminal receiving position are severed from the terminal belt B by the carrier cutting section 213, then the feeding section 215 transfers the resultant terminal T thus severed off to the terminal delivery position. With the terminal T at the terminal delivery position, an insulated electric wire W is transferred to the pressing position A of the press 250, whereby a bared conductor end W1 thereof is superimposed with the terminal T. Thereafter, the press 250 drives the shank 214E of the crimping section 214 to crimp the terminal T onto the insulated electric wire W.

By repeating the above operations in accordance with a type of insulated electric wire W to be transferred to the pressing position A, a continuous crimping of the terminal T can be performed. If the same type of terminal T is applied, a process for feeding a terminal belt B to the feeding section 215 and its subsequent processes may be repeated retaining the movable table 202 at the same position, thereby performing continuous crimping of the terminal T.

Figure 12:
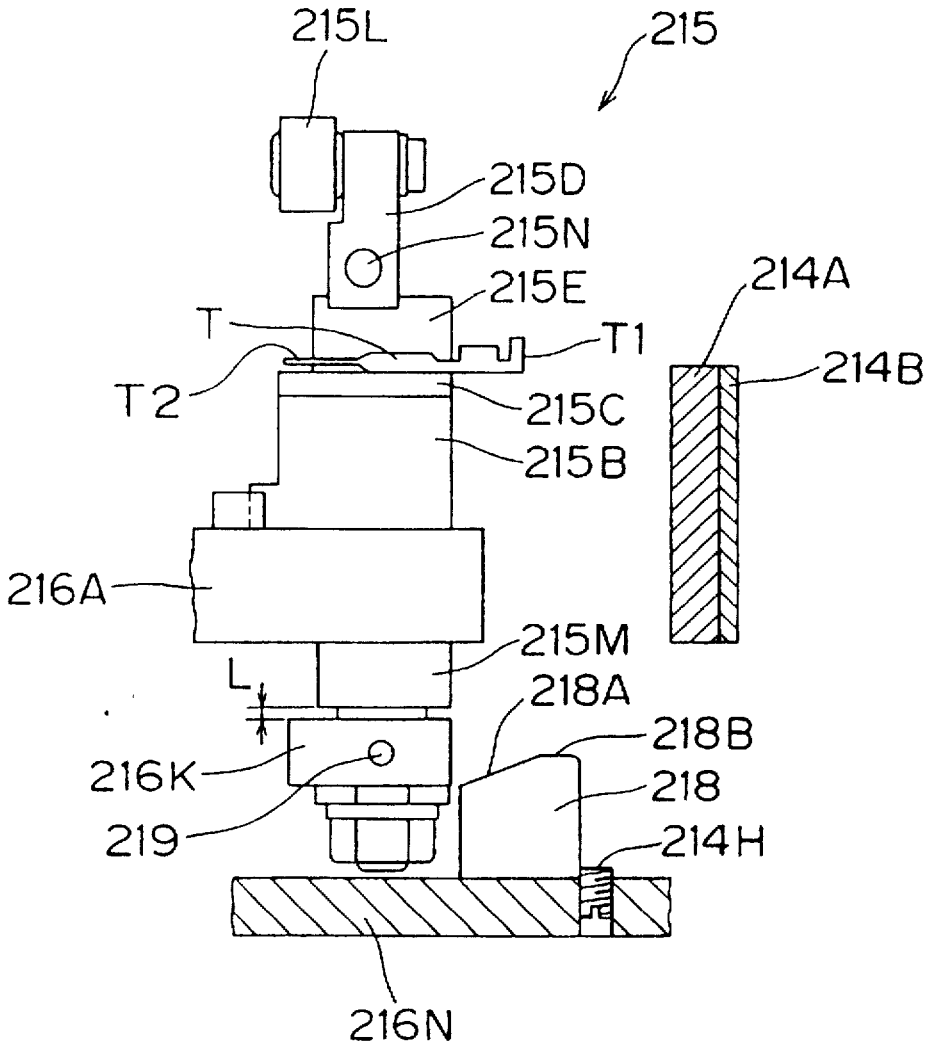
FIGS. 12 to 16 are schematic front views illustrating the operation of the terminal feeding unit.
Figure 13:
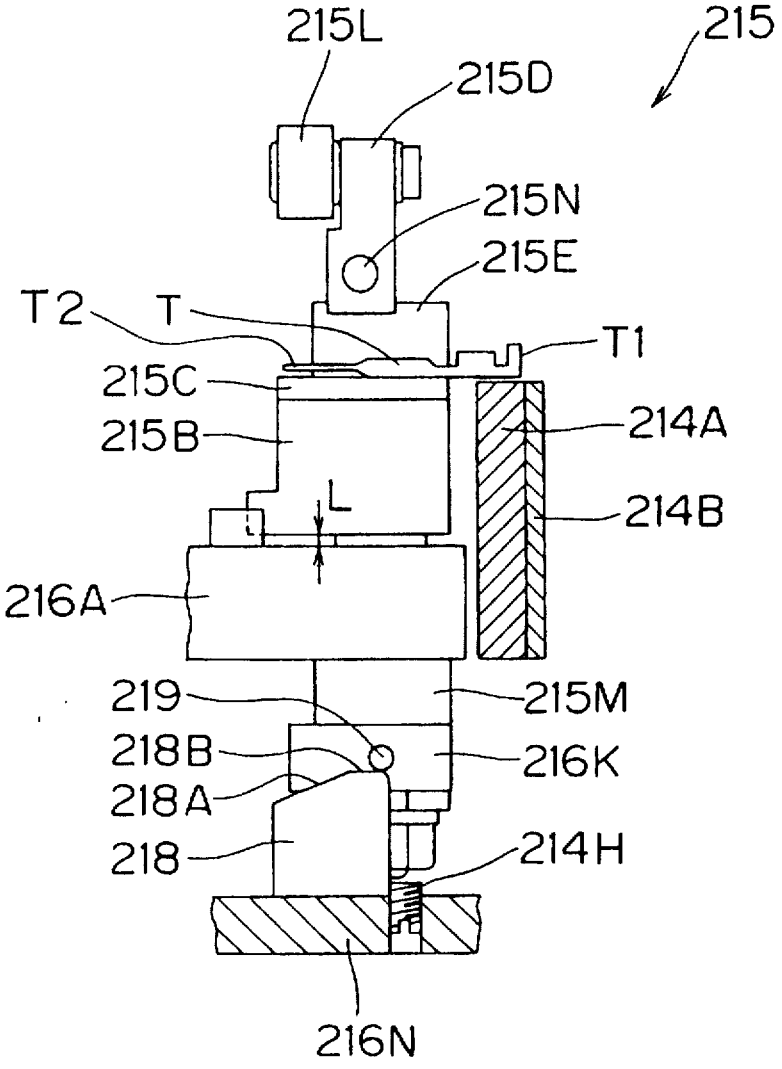
Figure 14:
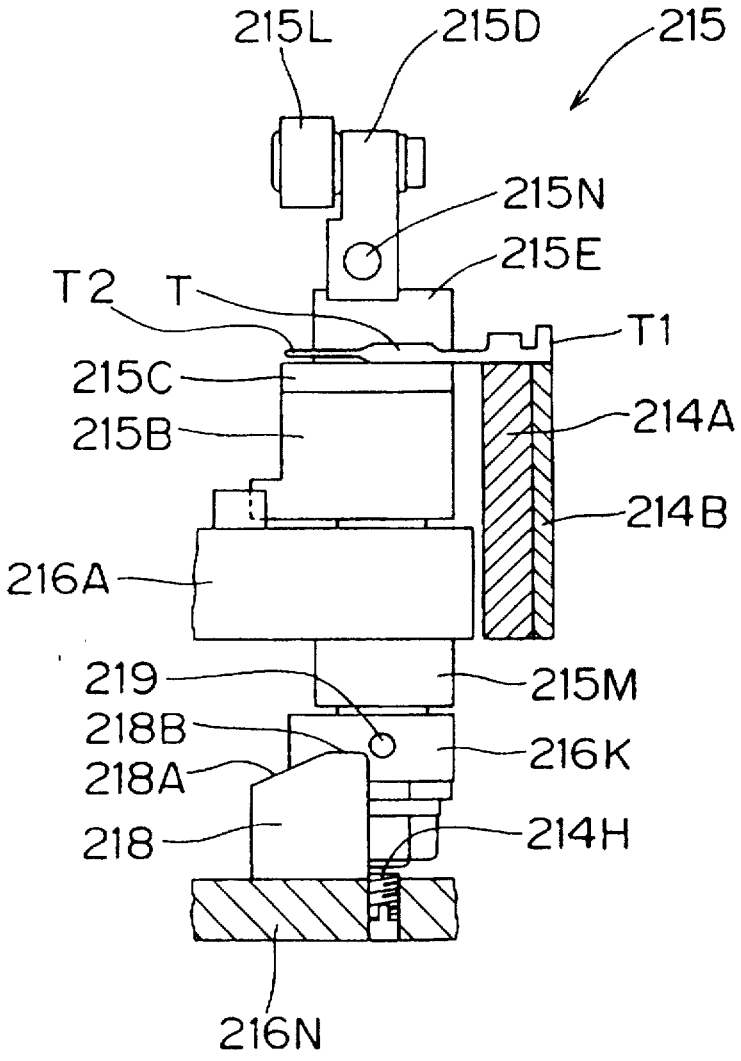

In the present embodiment, the feeding section 215 moving from the carrier cutting section 213 to the crimping section 214 brings the cam roller 219 into rolling contact with the camming surface of the cam projection 218, viz., the lifting slant 218A and the stop surface 218B thereof, as shown in FIG. 12, and thus the terminal T is fed from the carrier cutting section 213 to the pressure receiving surfaces of the anvils 214A and 214B of the crimping section 214, with the leading end T2 of the terminal T placed from above the pressure surfaces. This ensures that the terminal T is prevented from interfering with the anvil 214A at the upstream of the terminal feeding direction as it is delivered onto the pressure surfaces, as shown in FIG. 14.

Figure 15:
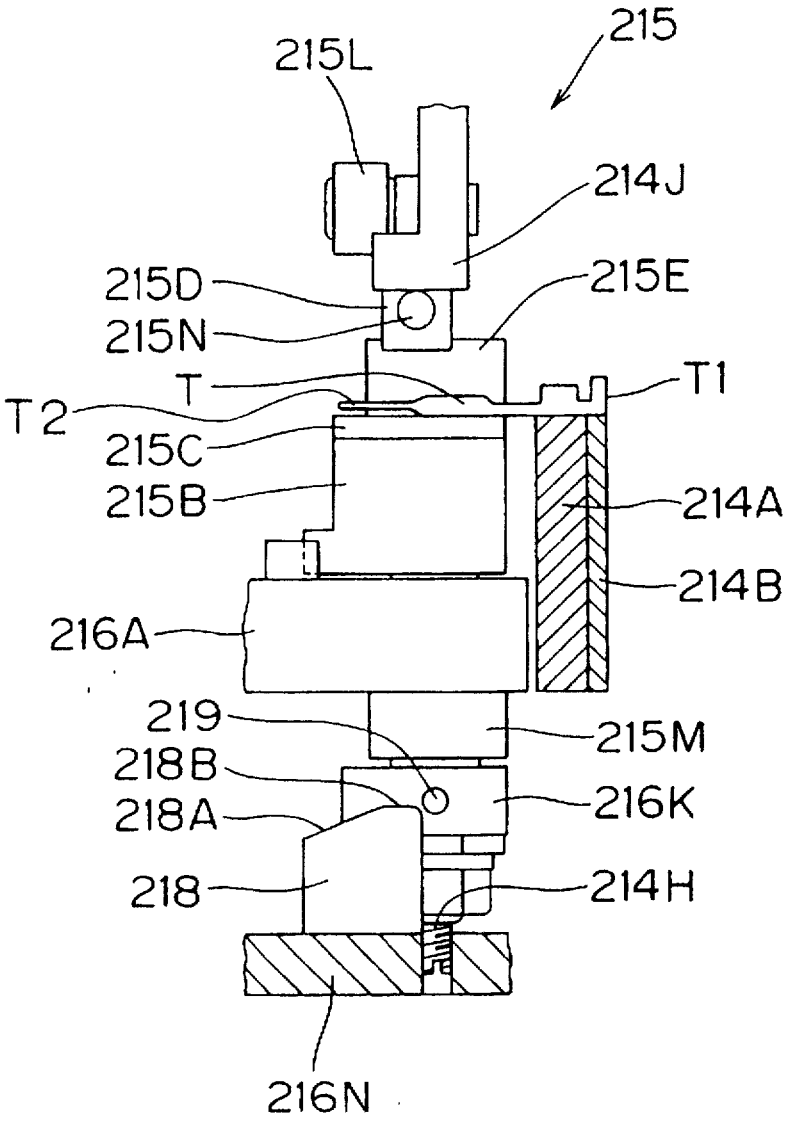
Figure 16:
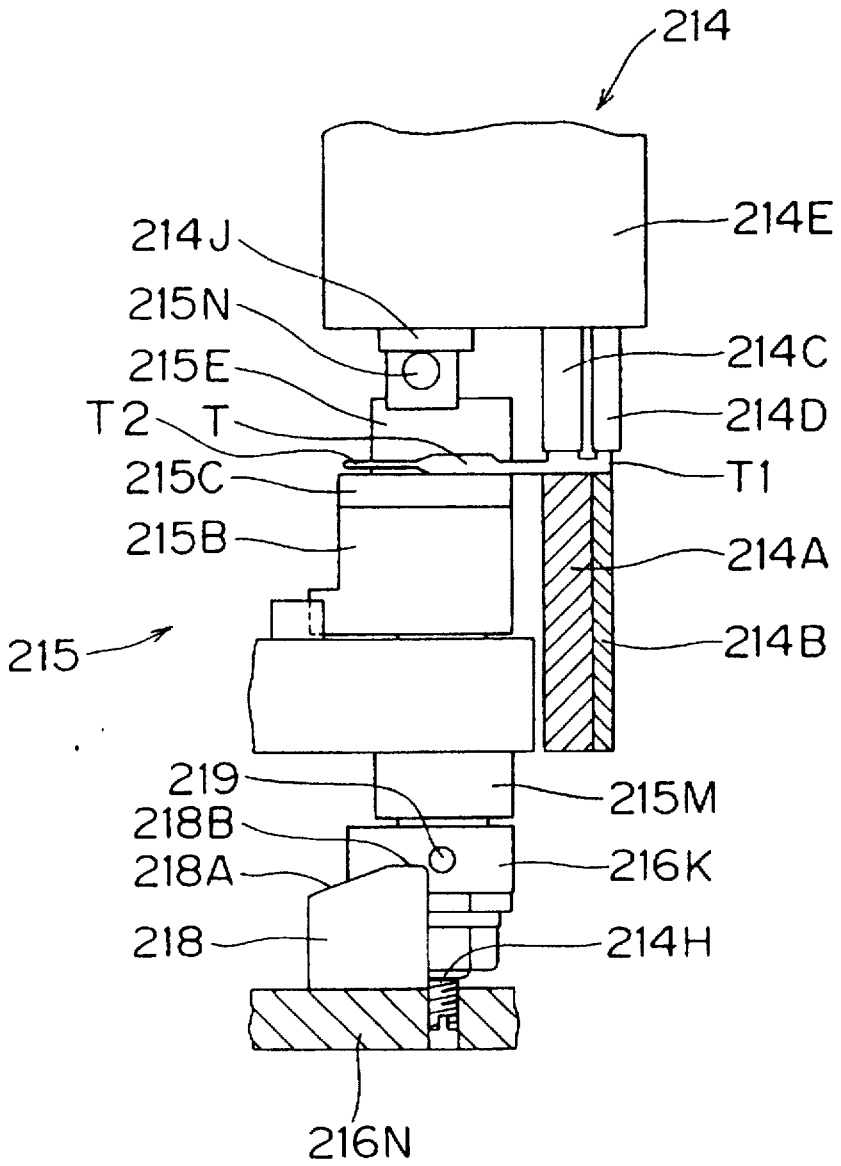

Prior to crimping of a terminal T, the feeding section 215 is pressed against the aforementioned set screw 214H by means of the press portion 214J, as shown in FIG. 15, so that the terminal T may be crimped between the anvils 214A, 214C and the crimpers 214B, 214D, with the terminal T caulked at a predetermined position (with a so-called tip end T2 side of the terminal inclined slightly downwardly), and then the terminal T is crimped onto an insulated electric wire W.

According to the arrangement of the present embodiment, the shortest possible path for transferring a terminal T to the pressing position A can be provided because after the terminal feeding unit 210 is transferred to align the crimping section 214 thereof with the press 250, the feeding section 215 simply needs to transfer a terminal T for its crimping process. Accordingly, this embodiment has an advantage to accomplish downsizing and cost reduction of the automated wire harness fabricating system 10.

Additionally, this embodiment is advantageously adapted for multi-item and small-lot production of wire harnesses, because after the terminal feeding unit 210 is transferred through a short path, the feeding section 215 simply needs to feed terminals T for continuous crimping of different types of terminals T, and hence, preparation time required for replacing terminal feeding units 210 is reduced.

Further according to the arrangement of this embodiment, a length along which the terminal feeding units 210 are sequentially disposed can be decreased, which results in a shorter stroke of the movable table 202 as the transfer means thereof. This leads to an advantage that the transfer distance and hence, the preparation time can be reduced even further. For example, the aforementioned embodiment allows six terminal feeding units 210 to be disposed sequentially in the length of 720 mm along the electric wire transfer direction D. If a terminal feed section is to advance a terminal belt B along the electric wire transfer direction D, a length along which the terminal feeding units 210 are disposed becomes longer by the length of the terminal belt B advanced. Hence, it will be readily understood that there is required a longer distance for the movable table 202 to drive the terminal feeding unit 210, or a longer preparation time. Such an arrangement comprising equivalent components to this embodiment requires the total length of 1848 mm for 6 terminal feeding units to be disposed sequentially. As described above, this embodiment provides the shortest possible length for the terminal feeding units 210 to be disposed sequentially, thereby overcoming the above described drawback.

Particularly the arrangement of the present embodiment has the following advantages; as interlocked with the feeding section 215 receiving a terminal portion BS at the terminal receiving position, an operation for severing the terminal portion BS from a terminal belt B is performed with the terminal portion BS securely clamped, and therefore, the feeding section 215 and the carrier cutting section 213 may be driven by a simplified mechanism expediting operations for severing and feeding the terminal portion BS; and additionally, the severing operation is performed with the terminal portion BS firmly clamped by the feeding section 215, whereby a terminal severing process of high accuracy is accomplished with terminal severing failure reduced as much as possible.

According to the arrangement of the present embodiment, crimping failure resulting from concurrent operation for crimping and severing a terminal is assuredly avoided, because an operation for severing a terminal portion BS from a terminal belt B and an operation for crimping the resultant terminal T thus severed onto a electric wire are performed sequentially.

Furthermore, as interlocked with receiving of the terminal portion BS at the terminal receiving position, the feeding section 215 clamps the terminal portion BS before the slide cutter severs the terminal portion BS from the terminal belt B, and therefore, the feeding section 215 and the carrier cutting section 213 may be driven by a simplified drive structure, expediting operations for severing and feeding the terminal portion BS. Also, the severing operation is carried out with the terminal portion BS firmly clamped by the feeding section 215, which assures a terminal severing process of high accuracy with terminal severing failure reduced as much as possible.

This embodiment has yet another advantage of being able to assuredly avoid terminal delivery failure because, in the course of delivery of a terminal T to the surfaces of the anvils 214A and 214B, the terminal T can be prevented from interfering with the anvil 214A.

A terminal T is stopped and secured on the pressure surfaces by the set screw 214H serving as stop means and the press portion 214J, in such a position as to be prevented from being deformed, and is subjected to the subsequent crimping operation, so that deformation in the crimped terminal T such as "bent-up" can be prevented during crimping operation. This advantageously eliminates need for correction of a deformed terminal T in the subsequent process. Particularly, the present embodiment employs the set screw 214H for positioning the lower surface of the feeding section 215, and thus has an advantage that height adjustment is facilitated.

The present invention is not limited to the above embodiment alone. The foregoing embodiment is a mere illustrative example for disclosing the technical nature of the present invention, and the present invention should not be interpreted in a narrow sense of meaning by limiting to this practical example only. Hence, the true spirit and scope of the present invention should be limited only by the description of the accompanying claims.

We claim:

1. A terminal feeding unit comprising:

a terminal delivery section for delivering a plurality of terminal portions in a form of a terminal belt having regular spatial intervals therebetween;

a carrier cutting section for severing the fed terminal portions from the terminal belt one by one;

a crimping section for crimping a resultant terminal severed off to an end of an insulated electric wire on a pressure receiving surface; and a feeding section which is disposed between said carrier cutting section and said crimping section, said feeding section is arranged to be movable between a terminal receiving position for clamping one of the terminal portions to be severed by said carrier cutting section and a terminal delivery position for delivering a resultant terminal severed off onto said pressure receiving surface, and said feeding section feeds the resultant terminal severed from the terminal belt by changing a position of the terminal for crimping operation.

2. A terminal feeding unit as set forth in claim 1, wherein:

said carrier cutting section includes a slide cutter driven by a pressure mechanism, for severing the terminal portion from the terminal belt after one of the terminal portions is fed from said terminal delivery section, and said feeding section includes a clamping mechanism driven by the pressure mechanism when the pressure mechanism drives said slide cutter, for clamping the terminal portion fed from said terminal delivery section prior to severing the terminal portion from the terminal belt by said cutter.

3. A terminal feeding unit as set forth in claim 2, wherein said clamping mechanism includes a terminal receiving plate for receiving one of the terminal portions, a terminal press for pressing the terminal portion against said terminal receiving plate, and a biasing member for biasing said terminal press to said terminal receiving plate.

4. A terminal feeding unit as set forth in claim 1, 2 or 3, further comprising a guide mechanism for guiding said feeding section so that said feeding section conveys a leading end of the terminal from up to down when said feeding section feeds the terminal onto the pressure receiving surface.

5. A terminal feeding unit as set forth in claim 4, wherein said guide mechanism includes a cam member for receiving a lower surface of said feeding section.

6. A terminal feeding section as set forth in claim 1, 2 or 3, wherein said crimping section further includes a stop member for, prior to terminal crimping, stopping the terminal on said pressure receiving surface through said feeding section at the terminal receiving position, upon preventing deformation of the terminal.

7. A terminal feeding unit as set forth in claim 6, wherein said stop member includes a pressing portion coupled to a shank of said crimping section by a biasing member.

8. A terminal feeding unit as set forth in claim 1, 2 or 3, wherein said feeding section feeds to said crimping section the terminal severed off by said carrier cutting section upon changing a position of the terminal by 90 degrees.

9. A multi-crimping apparatus incorporated into an automated wire harness fabricating system which automatically fabricates wire harnesses by intermittently processing an insulated wire, comprising:

a plurality of terminal feeding units as set forth in claim 1;

transfer mechanism for transferring said terminal feeding units so as to selectively locate one of said crimping sections thereof at a predetermined pressing position; and a press which drives the crimping section located in place, thereby crimping a terminal onto the insulated electric wire at the pressing position.

10. A multi-crimping press as set forth in claim 9 wherein the pressing position is located on a passage along which said transfer mechanism reciprocates said terminal feeding units.

11. A multi-crimping press as set forth in claim 9 or 10, wherein:

said automated wire harness fabricating system transfers an insulated electric wire to be terminated upon directing a conductor end of the insulated electric wire along a direction which is perpendicular to a wire transfer direction in which the insulated electric wire is transferred;

said terminal feeding units are sequentially disposed along the wire transfer direction;

said transfer mechanism shifts said terminal feeding units along the wire transfer direction;

said terminal delivery section advances a terminal belt to said carrier cutting section with terminal portions on the terminal belt being positioned along the wire transfer direction; and said feeding section changes the position of the terminal severed off by said carrier cutting section by 90 degrees.

* * * * *